US008072408B2

(12) United States Patent
Fujikura

(10) Patent No.: US 8,072,408 B2
(45) Date of Patent: Dec. 6, 2011

(54) LIQUID CRYSTAL DISPLAY DEVICE AND METHOD OF DRIVING THEREOF

(75) Inventor: Katsuyuki Fujikura, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1589 days.

(21) Appl. No.: 11/443,094

(22) Filed: May 31, 2006

(65) Prior Publication Data

US 2006/0274014 A1 Dec. 7, 2006

(30) Foreign Application Priority Data

Jun. 6, 2005 (JP) ..... 2005-166155

(51) Int. Cl.
*G09G 3/36* (2006.01)

(52) U.S. Cl. ..... 345/98

(58) Field of Classification Search ..... None
See application file for complete search history.

(56) References Cited

U.S. PATENT DOCUMENTS 5,936,598 A * 8/1999 Hayama et al. ..... 345/76
6,049,321 A * 4/2000 Sasaki ..... 345/99
7,327,344 B2 2/2008 Asada et al.
7,403,199 B2 * 7/2008 Kwak et al. ..... 345/211
2004/0178981 A1 9/2004 Asada et al.

FOREIGN PATENT DOCUMENTS

| | | |
|---|---|---|
| CN | 1530723 | 9/2004 |
| JP | 10-105113 | 4/1998 |
| JP | 2000-172231 | 6/2000 |
| JP | 2000-181405 | 6/2000 |

OTHER PUBLICATIONS

Chinese Office Action dated Jun. 27, 2008 with an English-Language Translation.

* cited by examiner

*Primary Examiner* — Alexander Eisen
*Assistant Examiner* — Robin Mishler
(74) *Attorney, Agent, or Firm* — McGinn IP Law Group, PLLC

(57) ABSTRACT

A liquid crystal display device according to the present invention has: a liquid crystal panel having a data line group; a data driver configured to drive the data line group of the liquid crystal panel by using a dot inversion driving method; and a power recovery circuit having an inductor. The inductor is configured to form an LC resonance circuit together with capacitance of the data line group and to collect electric power from the capacitance.

20 Claims, 5 Drawing Sheets

LIQUID CRYSTAL DISPLAY DEVICE AND METHOD OF DRIVING THEREOF

BACKGROUND OF THE INVENTION

1. Field of the Invention

The present invention relates to a liquid crystal display device and method of driving thereof. In particular, the present invention relates to a driving circuit which drives a liquid crystal panel by using a dot inversion driving method, a display device having the driving circuit, and a method of driving a liquid crystal panel.

2. Description of the Related Art

In driving a liquid crystal panel, an A.C. driving method is employed in order to improve reliability. According to the A.C. driving method, polarity of voltage applied to a liquid crystal is inverted every frame. Such a polarity inversion driving method is employed in particular in a liquid crystal panel of an active matrix type, and includes a gate line inversion (COM inversion) driving method, a data line inversion driving method and a dot inversion driving method which can prevent the flicker from occurring. According to the gate line inversion driving method, the polarity of voltages applied to data signal lines is inverted every gate signal line. According to the data line inversion driving method, the polarity of voltages applied to the data signal lines is inverted every data signal line. According to the dot inversion driving method, the polarity of voltages applied to the data signal lines is inverted every pixel in a horizontal direction and in a vertical direction.

According to the gate line inversion driving method, the voltage Vcom of a common electrode (COM electrode, counter electrode) can be switched. As a result, it is possible to reduce voltage amplitude of a video voltage about as half as that in the case of the dot inversion driving method and thus to suppress power consumption. In this case, however, the same polarity appears in line with the horizontal direction and thus the flicker causing a horizontal line tends to occur when a driving frequency is decreased. On the other hand, according to the dot inversion driving method, the voltage Vcom of the common electrode is fixed and the polarity of the video voltage is switched between the positive polarity and the negative polarity for each pixel. As a result, the flickers accompanying the inversion driving are canceled each other out between all the adjacent pixels. Thus, the flickers can be most suppressed and the visually highest picture quality can be realized.

With regard to a driving circuit of a display panel, the following techniques are disclosed, in which a power recovery circuit for collecting a part of driving electric power of the display panel is provided for the purpose of reducing the electric power consumption.

Japanese Laid-Open Patent Application JP-P2000-181405A discloses a method of driving a plasma display panel (PDP) having a power recovery circuit which collects electric power of an address electrode by using an LC resonance circuit. In the plasma display panel according to conventional technique, power collection and power reuse related to charging of electrostatic capacitance accompanying the load for a driving power supply are performed through the resonance between the electrostatic capacitance and an inductance element. The power recovery circuit has n (n is not less than 2) inductance elements connected in series and m (m is not less than 1 and not more than n) switching elements which are connected in parallel to respective of m of the inductance elements. The inductance of the power recovery circuit is changed in accordance with increase and decrease of the load such that power collection efficiency is kept constant.

Japanese Laid-Open Patent Application JP-P2000-172231A discloses a data line driving circuit having a charge collecting circuit which collects charges of the data line by the use of an LC resonance circuit. The data line driving circuit of a matrix display has: a sample/hold circuit for sampling data; a read/write circuit for transmitting the sampling data to an output circuit; the output circuit connected to a power supply, and amplifying and transmitting the received data to a liquid crystal panel; and the charge collecting circuit. The charge collecting circuit collects panel charges by switching a connection of a column line. A power supply interconnection for the output circuit is used not only for the charge supplying but for the charge collection, and is connected to the power recovery circuit which switches between the power supply and a charge collection path.

SUMMARY OF THE INVENTION

Although the flicker can be suppressed and hence a liquid crystal panel with high picture quality can be realized according to the dot inversion driving method, the amplitude of the driving voltage is increased (e.g. twice the liquid crystal driving voltage) since the voltage Vcom of the common electrode is kept constant. As a result, total power consumption of the liquid crystal display device is increased. In addition, it is necessary to design the breakdown voltage of an output circuit in a data driver about twice as large as that in the case of the COM inversion driving method, and thus a method of manufacturing ICs with higher breakdown voltage becomes necessary. Therefore, an area of a driver IC is increased and a cost of manufacturing the driver IC is also increased.

In an aspect of the present invention, a liquid crystal display device driven by the dot inversion driving method is provided. The liquid crystal display device is provided with: a liquid crystal panel having a data line group; a data driver configured to drive the data line group of the liquid crystal panel by using a dot inversion driving method; and a power recovery circuit having an inductor configured to form an LC resonance circuit together with capacitance of the data line group and to collect electric power from the capacitance. According to the liquid crystal display device thus configured, the energy accumulated in the capacitance of the data line group can be collected by the power recovery circuit.

The liquid crystal display device further has a power supply circuit configured to supply electric power used in the dot inversion driving to the data driver. The power recovery circuit feeds back a part of electric power collected by the inductor to the power supply circuit.

The data line group includes a first data line and a second data line adjacent to each other. The data driver has: a first driving amplifier configured to set a voltage of one of the first data line and the second data line to a positive polarity with respect to a voltage of a common electrode of the liquid crystal panel; and a second driving amplifier configured to set a voltage of the other of the first data line and the second line to a negative polarity with respect to a voltage of the common electrode. A corresponding data line driven by each of the first driving amplifier and the second driving amplifier is switched.

The data driver may further have: a timing control unit connected to the power recovery circuit; and a polarity switch unit provided between the first and second driving amplifiers and the first and second data lines. The timing control unit outputs a first control signal to the polarity switch unit.

The polarity switch unit connects between the first driving amplifier and the one of the first data line and the second data line and connects between the second driving amplifier and the other of the first data line and the second data line in response to the first control signal. The first driving amplifier drives the connected data line as a positive polarity data line to a positive polarity side. The second driving amplifier drives the connected data line as a negative polarity data line to a negative polarity side. The polarity switch unit switches the connection between the first and second driving amplifiers and the first and second data lines based on a level of the first control signal. As a result, the adjacent data lines can be driven to the positive polarity side and the negative polarity side, respectively.

The power recovery circuit collects the electric power of the capacitance such that the voltages of the positive polarity data line and the negative polarity data line do not exceed predetermined value, respectively. As a result, it is possible to set an initial voltage of the data line group within a range of the operation voltage of the data driver.

More specifically, the power recovery circuit collects electric power from capacitance of the positive polarity data line until a voltage of the positive polarity data line becomes a first initial voltage. Also, the power recovery circuit collects electric power from capacitance of the negative polarity data line until a voltage of the negative polarity data line becomes a second initial voltage. Then, the first driving amplifier circuit increases a voltage of the positive polarity data line from the first initial voltage toward the positive polarity side. The second driving amplifier circuit decreases a voltage of the negative polarity data line from the second initial voltage toward the negative polarity side.

The power recovery circuit further has a first recovery control circuit which is connected to both ends of the inductor and sets the first initial voltage and the second initial voltage. A flywheel current flows between the first recovery control circuit and the inductor in both of positive and negative directions. Since the flywheel current flows through the first recovery control circuit, the voltage between both ends of the inductor becomes the first initial voltage or the second initial voltage determined by the first recovery control circuit.

The first recovery control circuit may include a recovery control switch unit which switches a direction of the flywheel current in accordance with a polarity status of the data line group.

The data driver further has an individual data line switch unit configured to cut off an electrical connection between the data line group and the inductor at the time of the collection. The flywheel current flows between the first recovery control circuit and the inductor separated from the data line group.

The recovery control switch unit cuts off the flywheel current after the individual data line switch unit cuts off the electrical connection between the data line group and the inductor. The power recovery circuit further has a second recovery control circuit configured to feed a part of voltage between both ends of the inductor at the time when the flywheel current is cut off back to the power supply circuit.

The second recovery control circuit has: a first recovery circuit configured to feed the part of voltage to a positive polarity side power supply of the power supply circuit; and a second recovery circuit configured to feed the part of voltage to a negative polarity side power supply of the power supply circuit.

In the liquid crystal display device, the first data line is connected to one end of the inductor through a first node, while the second data line is connected to the other end of the inductor through a second node. The recovery control switch unit is provided between the first node and the second node. The first recovery control circuit further includes a first recovery control diode whose anode is connected to the recovery control switch unit and a second recovery control diode whose cathode is connected to the recovery control switch unit.

The timing control unit outputs to the recovery control switch unit a second control signal which controls the recovery control switch unit. In response to the second control signal, the recovery control switch unit connects between the first data line and the first recovery control diode and between the second data line and the second recovery control diode, or between the second data line and the first recovery control diode and between the first data line and the second recovery control diode.

The first recovery circuit may include: a third recovery control diode provided between the first node and the positive polarity side power supply; and a fifth recovery control diode provided between the second node and the positive polarity side power supply. The second recovery circuit includes: a fourth recovery control diode provided between the second node and the negative polarity side power supply; and a sixth recovery control diode provided between the first node and the negative polarity side power supply.

An electrical connection between the data driver and the data line group is cut off in response to a third control signal output from the timing control unit. The third recovery control diode discharges a part of electric power at the first node to the positive polarity side power supply. The fourth recovery control diode discharges a part of electric power at the second node to the negative polarity side power supply. The fifth recovery control diode discharges a part of electric power at the second node to the positive polarity side power supply. The sixth recovery control diode discharges a part of electric power at the first node to the negative polarity side power supply. As a result, the voltage between both ends of the inductor generated at the time when the flywheel current is cut off, namely, the part of energy left between both ends of the inductor can be returned to the power supply circuit.

According to the driving circuit and the display device of the present invention, it is possible not only to suppress the flickers excellently but also to reduce the power consumption of the display panel. Moreover, the area of the driver IC of the driving circuit can be reduced and hence the cost of manufacturing the driver IC can be reduced.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

Figure 1:
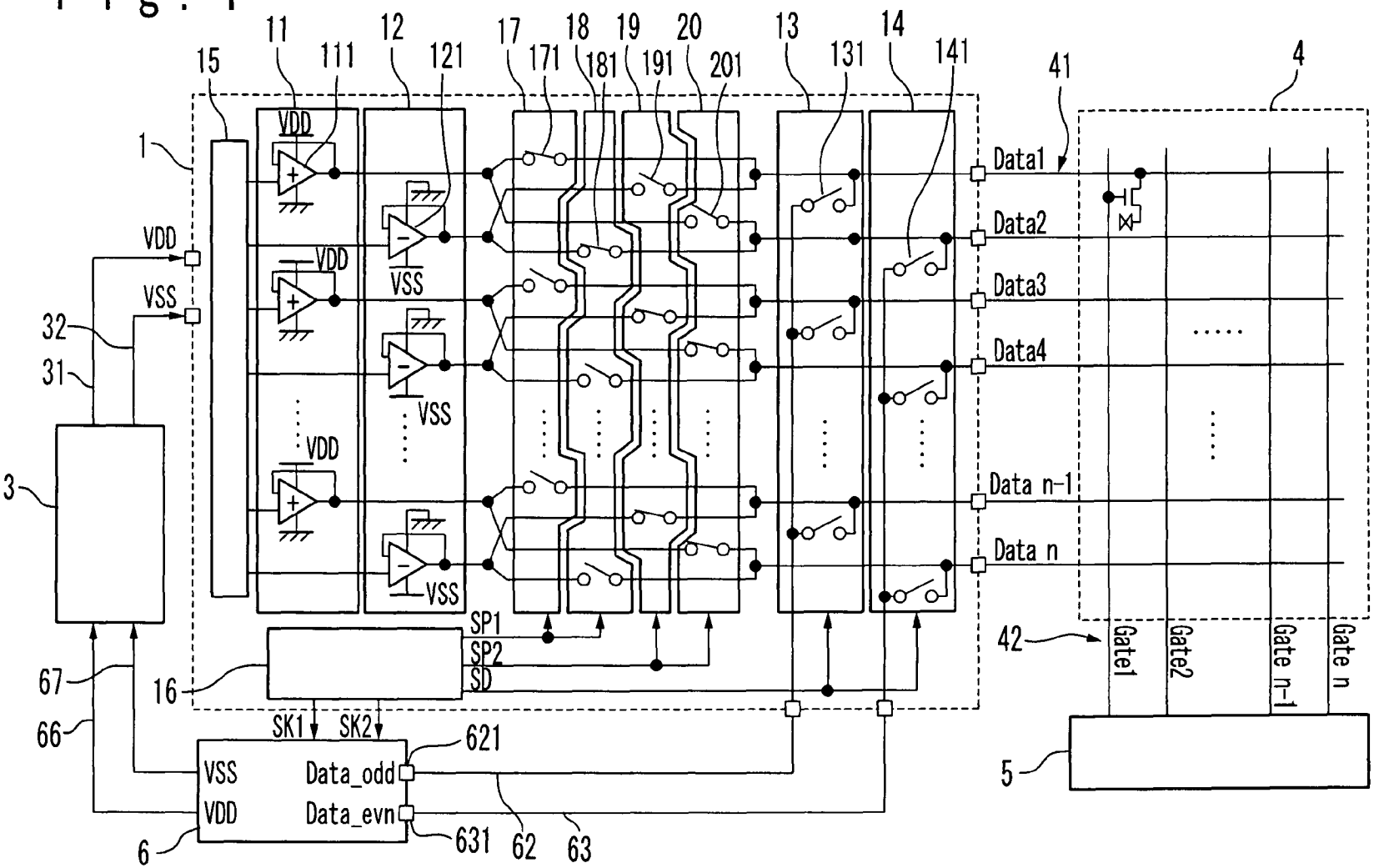
FIG. 1 is a diagram showing a configuration of a display device according to the present invention.

The invention will be now described herein with reference to illustrative embodiments. Those skilled in the art will recognize that many alternative embodiments can be accomplished using the teachings of the present embodiment and that the invention is not limited to the embodiments illustrated for explanatory purposed. In the present embodiment, a liquid crystal display device will be explained as an example of the display device. In the description below, the same reference numerals are given to the same components and the same elements.

(Configuration)

FIG. 1 shows a configuration of a display device according to an embodiment of the present invention. The display device is provided with a data driver 1, a power supply circuit 3, an LCD (Liquid Crystal Display) panel 4, a gate driver 5 and a power recovery circuit 6. In the LCD panel 4, a data line group 41 and a gate line group 42 are provided in a matrix form. The data line group 41 is connected to the data driver 1, and the gate line group 42 is connected to the gate driver 5. Also connected to the data driver 1 are the power recovery circuit 6 and the power supply circuit 3. The power recovery circuit 6 is connected to the power supply circuit 3 through a power discharge line 66 and a power discharge line 67.

The data driver 1 has: a positive polarity driving amplifier group 11 including n positive polarity driving amplifiers 111; a negative polarity driving amplifier group 12 including n negative polarity driving amplifiers 121; a polarity switch group 17 including m polarity switches 171; a polarity switch group 18 including m polarity switches 181; a polarity switch group 19 including m polarity switches 191; a polarity switch group 20 including m polarity switches 201; an individual data line switch group 13 including m individual data line switches 131; an individual data line switch group 14 including m individual data line switches 141; a gradation output circuit 15; and a timing control unit 16. Here, the n is an even number, and the m is a number represented by m=n/2.

The data line group 41 includes an odd-numbered data line group 413 (odd-numbered data lines Data1, 3, . . . , n−1) and an even-numbered data line group 414 (even-numbered data lines Data2, 4, . . . , n) The odd-numbered data line group 413 is connected to the positive polarity driving amplifier group 11 through the polarity switch group 17, and to the negative polarity driving amplifier group 12 through the polarity switch group 19. On the other hand, the even-numbered data line group 414 is connected to the positive polarity driving amplifier group 11 through the polarity switch group 20, and to the negative polarity driving amplifier group 12 through the polarity switch group 18. That is to say, respective of the odd-numbered data lines Data1, 3 . . . , n−1 are connected to the positive polarity driving amplifiers 111 through the polarity switches 171, and to the negative polarity driving amplifiers 121 through the polarity switches 191. On the other hand, respective of the even-numbered data lines Data2, 4 . . . , n are connected to the positive polarity driving amplifiers 111 through the polarity switches 201, and to the negative polarity driving amplifiers 121 through the polarity switches 181.

One ends of respective of the individual data line switches 131 of the individual data line switch group 13 are connected to the odd-numbered data lines Data1, 3 . . . , n−1, while the other ends are connected in common to a Data_odd terminal 621 of the power recovery circuit 6 through a power collection line 62. Similarly, one ends of respective of the individual data line switches 141 of the individual data line switch group 14 are connected to the even-numbered data lines Data2, 4, . . . , n, while the other ends are connected in common to a Data_evn terminal 631 of the power recovery circuit 6 through a power collection line 63.

As described above, the polarity switch groups 17, 18, 19, and 20 and the individual data line switch groups 13 and 14 constitute a polarity switch unit provided between the driving amplifier groups 11, 12 and the data lines.

The gradation output circuit 15 provides a gradation voltage to which a gamma correction is implemented in accordance with display characteristics of the LCD panel 4. Here, the gradation output circuit 15 provides respective of a positive polarity gradation voltage and a negative polarity gradation voltage for every other data lines, and applies the positive polarity gradation voltage and the negative polarity gradation voltage to input terminals of respective of the positive polarity driving amplifier group 11 and the negative polarity driving amplifier group 12.

In response to a signal received from a CPU (not shown), the timing control unit 16 outputs the following control signals in synchronization with the gate driver 5. That is, the timing control unit 16 outputs control signals SP1, SP2 and SD to the polarity switch unit (13, 14, 17, 18, 19, and 20), and also outputs control signals SK1 and SK2 to the power recovery circuit 6. The "on" and "off" of the polarity switch groups 17 and 18 are controlled by the control signal SP1 to be input. The "on" and "off" of the polarity switch groups 19 and 20 are controlled by the control signal SP2 to be input. Moreover, the "on" and "off" of the individual data line switch groups 13 and 14 are controlled by the control signal SD to be input. Thus, the amplifier group which drives a data line is controlled by the control signals, and the amplifier groups which drive adjacent data lines are switched by the control signals. The data driver 1 drives the LCD panel 4 based on the dot inversion driving method.

The power supply circuit 3 is connected to the data driver 1 through a power supply line 31 and a power supply line 32. The power supply circuit 3 supplies to the data driver 1 a positive polarity power supply VDD through the power supply line 31 and a negative polarity power supply VSS through the power supply line 32. The positive polarity power supply VDD and the negative polarity power supply VSS are external power supply of a data driver IC, which are generally controlled by a regulator not shown.

The gate driver 5 selectively drives gate lines Gate1 to n of the gate line group 42 at a timing determined by a signal output from a controller not shown.

Figure 2:
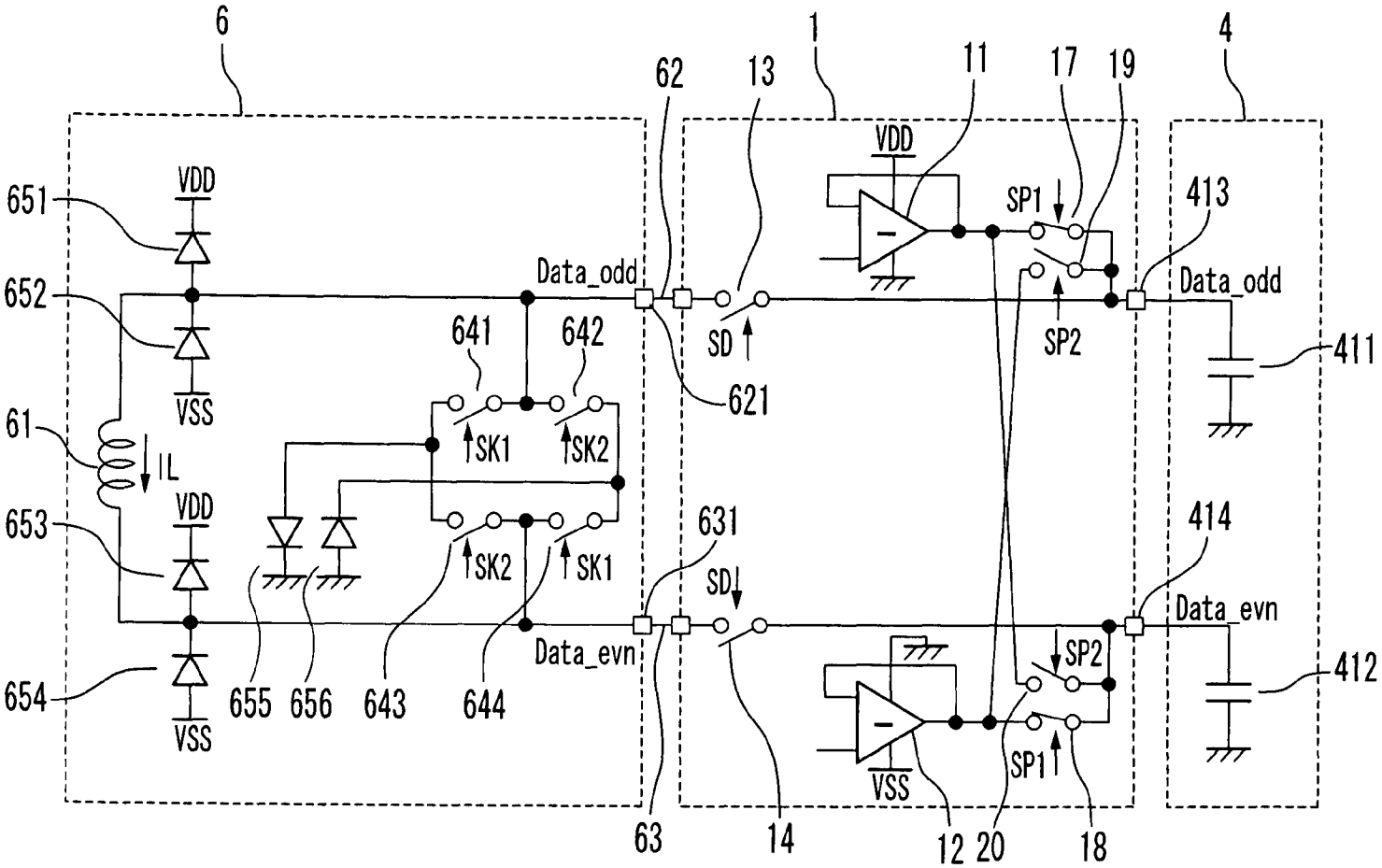
FIG. 2 is a diagram showing a detailed configuration of a power recovery circuit according to the present invention.

FIG. 2 shows a detailed configuration of a part of the display device, especially of the power recovery circuit 6 according to the present embodiment. The power recovery circuit 6 is provided with an inductor 61, the Data_odd terminal 621, the Data_evn terminal 631, recovery control switches 641 to 644, recovery control diodes 651 to 654, and recovery control diodes 655 and 656. The "on" and "off" of the recovery control switches 641 and 644 are controlled by the control signal SK1 to be input, while the "on" and "off" of the recovery control switches 642 and 643 are controlled by the control signal SK2 to be input. Moreover, a total load capacitance of the all odd-numbered data line group 413 in the LCD panel 4 is represented as an odd-numbered data line capacitance 411. On the other hand, a total load capacitance of the all even-numbered data line group 414 is represented as an even-numbered data line capacitance 412.

The Data_odd terminal 621 is connected to one end of the inductor 61, an anode electrode of the recovery control diode 651, a cathode electrode of the recovery control diode 652, one end of the recovery control switch 641 and one end of the recovery control switch 642 of the power recovery circuit 6. The Data_evn terminal 631 is connected to the other end of the inductor 61, an anode electrode of the recovery control diode 653, a cathode electrode of the recovery control diode 654, one end of the recovery control switch 643 and one end of the recovery control switch 644.

Thus, the one end of the inductor 61 of the power recovery circuit 6 is connected to the individual data line switch group 13 of the data driver 1 through the Data_odd terminal 621 and the power collection line 62. The other end of the inductor 61 is connected to the individual data line switch group 14 of the data driver 1 through the Data_evn terminal 631 and the power collection line 63. Moreover, the power collection line 62 is connected to the one ends of the recovery control switch 641 and the recovery control switch 642 through the Data_odd terminal 621, while the power collection line 63 is connected to the one ends of the recovery control switch 643 and the recovery control switch 644 through the Data_evn terminal 631.

Meanwhile, the other ends of the recovery control switch 641 and the recovery control switch 643 are connected in common to an anode electrode of the recovery control diode 655. The other ends of the recovery control switch 642 and the recovery control switch 644 are connected in common to a cathode electrode of the recovery control diode 656. A cathode electrode of the recovery control diode 655 and an anode electrode of the recovery control diode 656 are connected to the ground GND.

The power collection line 62 is connected to the anode electrodes of the recovery control diode 651 and the recovery control diode 653 through the Data_odd terminal 621, while the power collection line 63 is connected to the cathode electrodes of the recovery control diode 652 and the recovery control diode 654 through the Data_evn terminal 631. The cathode electrodes of the recovery control diode 651 and the recovery control diode 653 are connected to the positive polarity power supply VDD, while the anode electrodes of the recovery control diode 652 and the recovery control diode 654 are connected to the negative polarity power supply VSS. It should be noted that each of the recovery control diodes 651, 652, 653, 654, 655 and 656 described above is preferably the one having a small forward direction voltage VF such as a Schottky barrier diode so that the energy loss in the recovery operation is reduced.

The inductor 61 of the power recovery circuit 6 forms an LC resonance circuit together with the odd-numbered data line capacitance 411 and the even-numbered data line capacitance 412. The power recovery circuit 6 collects electric power from the odd-numbered data line capacitance 411 and the even-numbered data line capacitance 412. The power recovery circuit 6 feeds back a part of the electric power collected by the inductor 61 to the power supply circuit 3.

Figure 3:
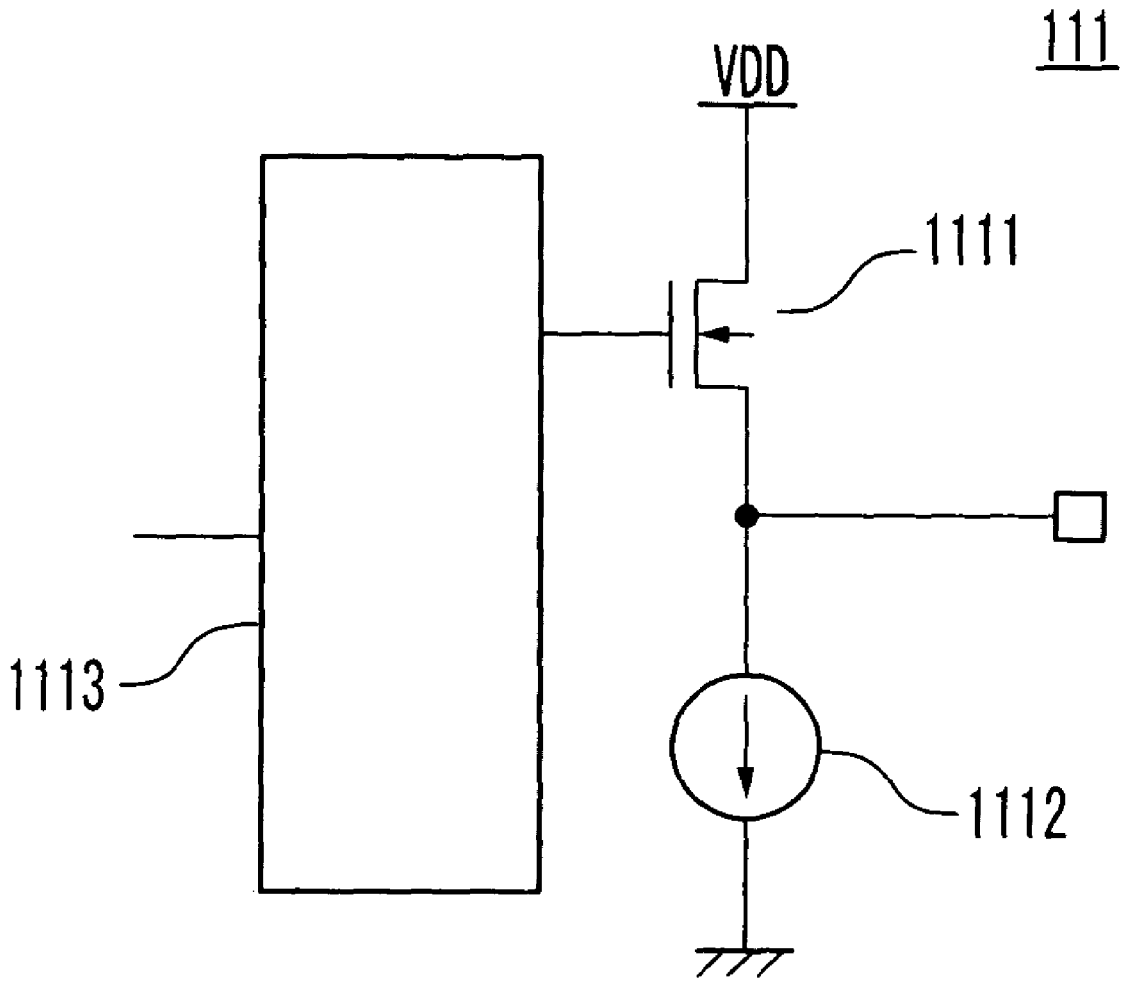
FIG. 3 is a diagram showing a configuration of a positive polarity driving amplifier according to the present invention.
Figure 4:
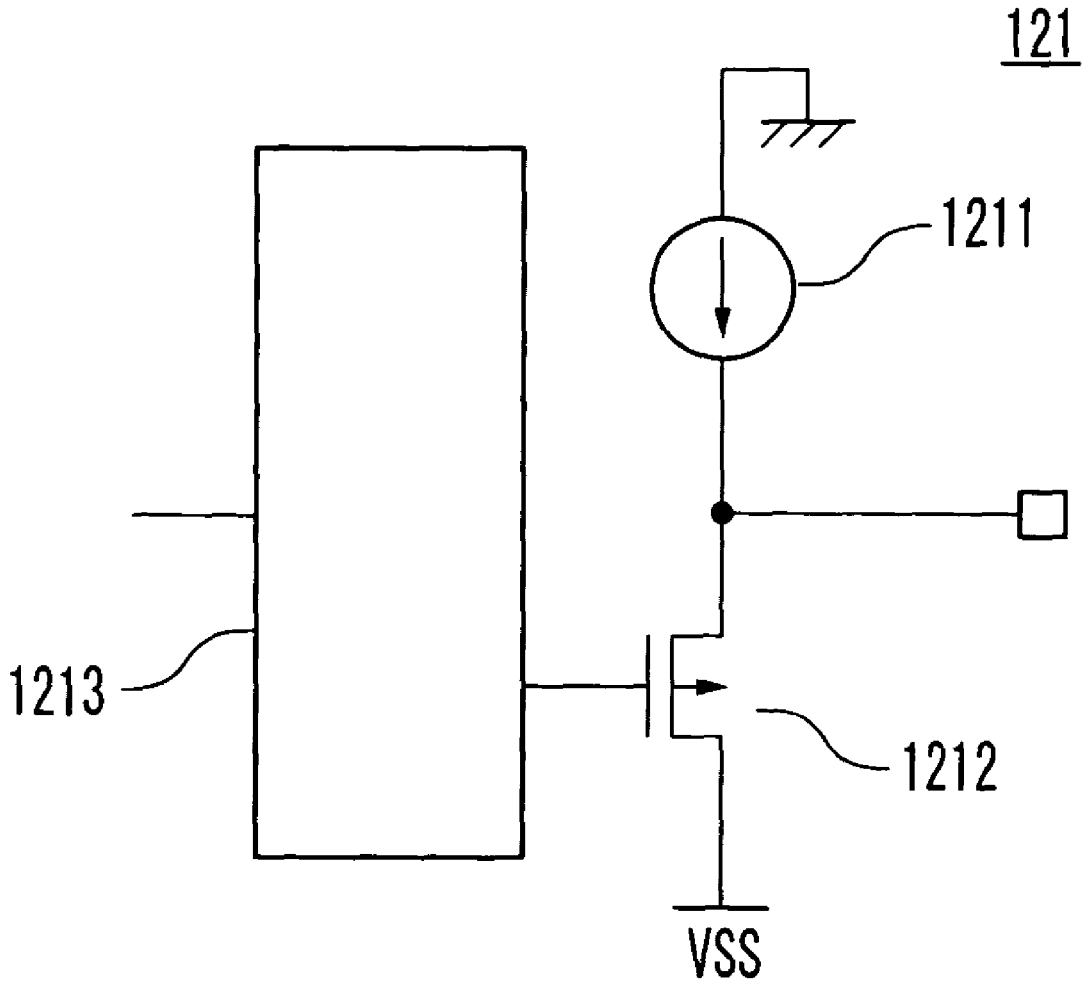
FIG. 4 is a diagram showing a configuration of a negative polarity driving amplifier according to the present invention.

FIG. 3 is a diagram showing a configuration of the positive polarity driving amplifier 111 according to the present embodiment. FIG. 4 is a diagram showing a configuration of the negative polarity driving amplifier 121 according to the present embodiment. Referring to FIG. 3, the positive polarity driving amplifier 111 includes a preamplifier circuit 1113 and an output stage which is configured with an output transistor 1111 and a constant current source load 1112. The output transistor 1111 is a P-channel transistor connected to the positive polarity power supply VDD, and a current output side electrode of the constant current source load 1112 is connected to the ground GND. Referring to FIG. 4, the negative polarity driving amplifier 121 includes a preamplifier circuit 1213 and an output stage which is configured with an output transistor 1212 and a constant current source load 1211. The output transistor 1212 is an N-channel transistor connected to the negative polarity power supply VSS, and a current input side electrode of the constant current source load 1211 is connected to the ground GND.

(Operation)

Figure 5:
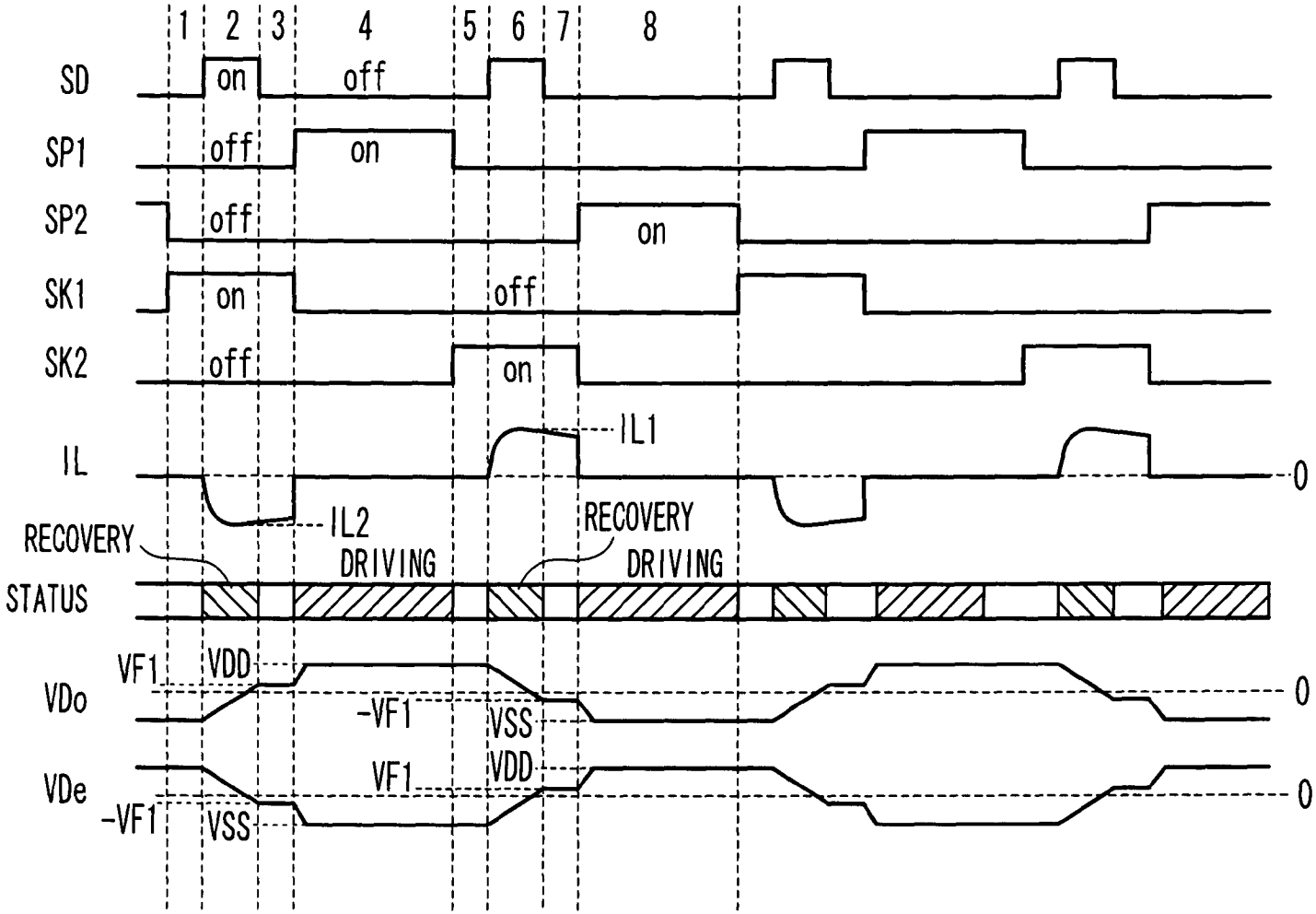
FIG. 5 is a timing chart showing a driving operation of the display device according to the present invention.

FIG. 5 is a timing chart showing a driving operation of the display device according to the present embodiment. Shown in FIG. 5 are the control signals SD, SP1 and SP2 input to the data driver 1, the control signals SK1 and SK2 input to the power recovery circuit 6, a collection current IL, a status of the odd-numbered data line group 413 and the even-numbered data line group 414, a driving voltage VDo of the odd-numbered data line group 413, and a driving voltage VDe of the even-numbered data line group 414. Described below are Periods 1 to 8 during which the driving voltage VDo of the odd-numbered data line group 413 changes from negative to positive and returns to negative again according to the operation of the dot inversion driving. The driving state of the even-numbered data line group 414 is completely opposite to that of the odd-numbered data line group 413.

(Period 1)

The polarity switch group 17 and the polarity switch group 18 are turned "off" by the control signal SP1 of Low-level received from the timing control unit 16. Also, the polarity switch group 19 and the polarity switch group 20 are turned "off" by the control signal SP2 of Low-level received from the timing control unit 16. Moreover, the recovery control switch 641 and the recovery control switch 644 are turned "on" by the control signal SK1 of High-level received from the timing control unit 16. As a result, the odd-numbered data line capacitance 411 and the even-numbered data line capacitance 412 are separated from the positive polarity driving amplifier group 11 and the negative polarity driving amplifier group 12.

(Period 2)

The control signal SD output from the timing control unit 16 changes from Low-level to High-level, and hence the individual data line switch group 13 and the individual data line switch group 14 are turned "on". As a result, the odd-numbered data line capacitance 411, the even-numbered data line capacitance 412 and the inductor 61 form an LC resonance circuit, and thus the collection (recovery) current IL flows through the inductor 61 from the side of the even-numbered data line capacitance 412 to the side of the odd-numbered data line capacitance 411. Accordingly, the driving voltage VDo of the odd-numbered data line group 413 is increased from the VSS side toward the GND side, while the driving voltage VDe of the even-numbered data line group 414 is decreased from the VDD side toward the GND side. When the driving voltage VDo of the odd-numbered data line group 413 and the driving voltage VDe of the even-numbered data line group 414 become equivalent to each other, the collection current IL takes a maximum value of IL2. When the forward direction voltage of the recovery control diode 655 and the recovery control diode 656 is represented by VF1, the driving voltage VDo of the odd-numbered data line group 413 does not become more than VF1 and the driving voltage VDe of the even-numbered data line group 414 does not become less than −VF1, since the recovery control switch 641 and the recovery control switch 644 are turned on. In this case, a flywheel current IL flows through a current path: the recovery control diode 656—the recovery control switch 644—the inductor 61—the recovery control switch 641—the recovery control diode 655. Ideally, the flywheel current IL is maintained at the value IL2. However, in a practical circuit, the flywheel current IL is gradually attenuated because power is consumed by the parasitic resistance of the current path. It is therefore preferable that each of the recovery control diodes 655 and 656 is a Schottky barrier diodes or the like which has a small forward direction voltage VF1.

(Period 3)

The control signal SD is changed to Low-level during the flywheel current flows through the inductor 61, and thus the individual data line switch group 13 and the individual data line switch group 14 are turned "off". As a result, the odd-numbered data line capacitance 411 and the even-numbered data line capacitance 412 are separated from the power recovery circuit 6.

(Period 4)

Following the control signal operation in the Period 3, the control signal SP1 input from the timing control unit 16 is changed from Low-level to High-level, and thus the polarity switch group 17 and the polarity switch group 18 are turned "on". As a result, the odd-numbered data line capacitance 411 is driven to the positive polarity side by the positive polarity driving amplifier group 11, and hence the driving voltage VDo of the odd-numbered data line capacitance 411 is increased from VF1 toward the VDD side. On the other hand, the even-numbered data line capacitance 412 is driven to the negative polarity side by the negative driving amplifier group 12, and hence the driving voltage VDe of the even-numbered data line capacitance 412 is decreased from −VF1 toward the VSS side.

Meanwhile, the control signal SK1 is changed from High-level to Low-level at substantially the same time when the control signal SP1 is changed to High-level. As a result, the recovery control switch 641 and the recovery control switch 644 are turned "off", and the flywheel current IL2 is cut off. Accordingly, a positive high voltage appears at the Data_odd terminal 621, while a negative high voltage simultaneously appears at Data_evn terminal 631. These high voltages are generated as a result that the current energy of the inductor 61 is converted into the voltage energy.

Here, the positive polarity side power supply VDD of the power supply circuit 3 is connected to the recovery control diode 651 through the power discharge line 66, while the negative polarity side power supply VSS is connected to the power recovery control diode 654 through the power discharge line 67. The forward direction voltage of these diodes 651, 654 is represented by VF2. When the positive high voltage generated at the Data_odd terminal 621 becomes more than VDD+VF2, the voltage energy flows to the positive polarity side power supply VDD. On the other hand, when the negative high voltage generated at the Data_evn terminal 631 becomes less than VSS−VF2, the voltage energy flows to the negative polarity side power supply VSS. It is preferable that a fast recovery diode or the like having a small junction capacitance is used as the recovery control diode 651 and the recovery control diode 654 such that the voltage energy flows promptly from the inductor 61 to the positive polarity side power supply VDD or the negative polarity side power supply VSS.

Each of the positive polarity side power supply VDD and the negative polarity side power supply VSS is an external power supply of the data driver IC, and is generally controlled by a regulator not shown. A power supply output terminal of the regulator is connected to a smoothing capacitor. When the output voltage is decreased due to increase in the load current, the regulator operates to make up for the deficiency of the voltage and to keep the output voltage of the output terminal at VDD or VSS which is a predetermined output voltage. Here, by connecting the recovery control diode 651 and the recovery control diode 654 to respective of output terminals of the positive polarity side power supply VDD and the negative polarity side power supply VSS, the positive voltage energy and the negative voltage energy generated in the power recovery circuit 6 are fed back to respective of the positive polarity side power supply VDD and the negative polarity side power supply VSS. As a result, the voltage deficiency at the power supply output terminal can be covered by the fed-back energy, and the regulator needs not to compensate the voltage decrease. It is thus possible to reduce the power consumption in the power supply.

(Period 5)

The control signal SP1 is changed to Low-level, and hence the polarity switch group 17 and the polarity switch group 18 are turned off. Moreover, the control signal SK2 is changed from Low-level to High-level, and hence the recovery control switch 642 and the recovery control switch 643 are turned on. In the period, the odd-numbered data line capacitance 411 and the even-numbered data line capacitance 412 are separated from the positive polarity driving amplifier group 11 and the negative polarity driving amplifier group 12.

(Period 6)

The control signal SD output from the timing control unit 16 changes from Low-level to High-level, and hence the individual data line switch group 13 and the individual data line switch group 14 are turned "on". As a result, the odd-numbered data line capacitance 411, the even-numbered data line capacitance 412 and the inductor 61 form an LC resonance circuit, and thus the collection (recovery) current IL flows through the inductor 61 from the side of the odd-numbered data line capacitance 411 to the side of the even-numbered data line capacitance 412. Accordingly, the driving voltage VDo of the odd-numbered data line group 413 is decreased from the VDD side to the GND side, while the driving voltage VDe of the even-numbered data line group 414 is increased from the VSS side to the GND side. When the driving voltage VDo of the odd-numbered data line group 413 and the driving voltage VDe of the even-numbered data line group 414 become equivalent to each other, the collection current IL takes a maximum value of IL1. When the forward direction voltage of the recovery control diode 655 and the recovery control diode 656 is represented by VF1, the driving voltage VDo of the odd-numbered data line group 413 does not become less than −VF1 and the driving voltage VDe of the even-numbered data line group 414 does not become more than VF1, since the recovery control switch 642 and the recovery control switch 643 are turned on. In this case, a flywheel current IL flows through a current path: the recovery control diode 656—the recovery control switch 642—the inductor 61—the recovery control switch 643—the recovery control diode 655. Ideally, the flywheel current IL is maintained at the value IL1. However, in a practical circuit, the flywheel current IL is gradually attenuated because power is consumed by the parasitic resistance of the current path. It is therefore preferable that each of the recovery control diodes 655 and 656 is a Schottky barrier diodes or the like which has a small forward direction voltage VF1.

(Period 7)

Operation is the same as in the above-mentioned Period 3.

(Period 8)

Following the control signal operation in the Period 7, the control signal SP2 input from the timing control unit 16 is changed from Low-level to High-level, and thus the polarity switch group 19 and the polarity switch group 20 are turned "on". As a result, the odd-numbered data line capacitance 411 is driven to the negative polarity side by the negative polarity driving amplifier group 12, and hence the driving voltage VDo of the odd-numbered data line capacitance 411 is decreased from −VF1 to the VSS side. On the other hand, the even-numbered data line capacitance 412 is driven to the positive polarity side by the positive driving amplifier group 11, and hence the driving voltage VDe of the even-numbered data line capacitance 412 is increased from VF1 to the VDD side.

Meanwhile, the control signal SK2 is changed from High-level to Low-level at substantially the same time when the control signal SP2 is changed to High-level. As a result, the recovery control switch 642 and the recovery control switch 643 are turned "off", and the flywheel current IL1 is cut off. Accordingly, a negative high voltage appears at the Data_odd terminal 621, while a positive high voltage simultaneously appears at Data_evn terminal 631. These high voltages are generated as a result that the current energy of the inductor 61 is converted into the voltage energy.

Here, the positive polarity side power supply VDD of the power supply circuit 3 is connected to the recovery control diode 652 through the power discharge line 66, while the negative polarity side power supply VSS is connected to the power recovery control diode 653 through the power discharge line 67. The forward direction voltage of these diodes 652, 653 is represented by VF2. When the positive high voltage generated at the Data_evn terminal 631 becomes more than VDD+VF2, the voltage energy flows to the positive polarity side power supply VDD. On the other hand, when the negative high voltage generated at the Data_odd terminal 621 becomes less than VSS−VF2, the voltage energy flows to the negative polarity side power supply VSS. It is preferable that a fast recovery diode or the like having a small junction capacitance is used as the recovery control diode 652 and the recovery control diode 653 such that the voltage energy flows promptly from the inductor 61 to the positive polarity side power supply VDD or the negative polarity side power supply VSS.

With reference to FIG. 3, it is necessary to design the amplifier circuit to operate in a range from the ground GND to the voltage VDD, in order to set the amplifier breakdown voltage of the positive polarity driving amplifier 111 substantially equal to the liquid crystal driving voltage. Therefore, when the polarity switch groups 17, 18, 19 and 20 are switched in using the power recovery circuit 6, the voltage applied to the output terminal of the positive polarity driving amplifier 111 from the side of the LCD panel 4 is set in the range between GND and VDD. Since there is no potential falling function in the positive polarity driving amplifier 111, the load voltage at the starting point of the amplifier driving should be set near the ground GND.

Referring to FIG. 2, since the voltage of the odd-numbered data line capacitance 411 does not become more than the VF1 in the above-mentioned Period 2, the load voltage at the starting point of the amplifier driving is the VF1. Therefore, it is enough that the positive polarity driving amplifier 111 executes the voltage rising operation. Moreover, since the voltage applied to the output terminal of the amplifier is VDD−VF, the breakdown voltage of the amplifier may be practically the same as the VDD which is the liquid crystal operation voltage. The driving voltage of the even-numbered data line capacitance 412 may be small and little positive charge remains according to a pattern to be displayed. Even if the voltage of the odd-numbered data line capacitance 411 does not reach the ground GND from the VSS after the power collection, the odd-numbered data line capacitance 411 is clamped to the ground GND by the recovery control diode 656 and hence the initial driving voltage of the positive polarity driving amplifier 111 is at least in the positive side as compared with −VF1. Accordingly, the load voltage at the starting point of the amplifier driving is −VF1 and the largest voltage applied by the amplifier is VDD+VF1, which means that the breakdown voltage of the amplifier can be practically the same as the VDD which is the liquid crystal operation voltage.

As for the negative polarity driving amplifier 121, the opposite to the case of the positive polarity driving amplifier 111 can be applied with reference to FIG. 4. As a result of a similar consideration, the load voltage at the starting point of the amplifier driving is VF1, and the largest voltage applied by the amplifier is VSS+VF1.

If we assume that the liquid crystal driving voltage is approximately symmetrical between the positive polarity side and the negative polarity side, the negative polarity side power supply VSS can be considered as substantially equivalent to the positive polarity side power supply VDD. In this case, the breakdown voltages of the positive polarity driving amplifier 111 and the negative polarity driving amplifier 121 can be set substantially the same as the liquid crystal driving voltage. Therefore, the breakdown voltage of the transistors constituting the liquid crystal driving circuit according to the present embodiment can be suppressed. In other words, it is possible to reduce the size of the driver chip and hence to reduce the cost of manufacturing the driver chip. Moreover, since the recovery energy accumulated by the inductor 61 is returned to the power supply without transferring to a recovery capacitance, it is possible to reduce the cost of providing external parts.

As described above, the driving circuit and the display device according to the present embodiment can reduce the flickers between the data lines by employing the dot inversion driving method. Furthermore, the poser consumption can be reduced by suppressing the amplitude of the driving voltage of the liquid crystal panel.

It is apparent that the present invention is not limited to the above embodiment, and that may be modified and changed without departing from the scope and spirit of the invention.

What is claimed is:

1. A liquid crystal display device, comprising:

a liquid crystal panel having a data line group;

a data driver configured to drive said data line group of said liquid crystal panel by using a dot inversion driving method;

a power recovery circuit having an inductor configured to form an LC resonance circuit together with a capacitance of said data line group, and to collect electric power from said capacitance; and a power supply circuit configured to supply electric power used in said dot inversion driving to said data driver, said power supply circuit comprising a positive polarity side power supply and a negative polarity side power supply that are different from ground, wherein said power recovery circuit further comprises a plurality of first and second recovery diodes, and wherein electrodes of said inductor are respectively connected to said positive polarity side power supply and said negative polarity side power supply of said power supply circuit through said plurality of first recovery diodes, and further connected through power recovery switches and said plurality of second recovery diodes to the ground.

2. The liquid crystal display device according to claim 1, wherein said data line group includes a first data line and a second data line adjacent to each other, said data driver comprises:

a first driving amplifier configured to set a voltage of one of said first data line and said second data line to a positive polarity with respect to a voltage of a common electrode of said liquid crystal panel; and a second driving amplifier configured to set a voltage of the other of said first data line and said second line to a negative polarity with respect to a voltage of said common electrode, wherein a corresponding data line driven by each of said first driving amplifier and said second driving amplifier is switched.

3. The liquid crystal display device according to claim 2, wherein said data driver further comprises:

a timing control unit connected to said power recovery circuit; and a polarity switch unit provided between said first and second driving amplifiers and said first and second data lines, wherein said timing control unit outputs a first control signal to said polarity switch unit, said polarity switch unit connects between said first driving amplifier and said one of said first data line and said second data line and connects between said second driving amplifier and said other of said first data line and said second data line in response to said first control signal, said first driving amplifier drives said connected data line as a positive polarity data line to a positive polarity side, said second driving amplifier drives said connected data line as a negative polarity data line to a negative polarity side, and said polarity switch unit switches said connection between said first and second driving amplifiers and said first and second data lines based on a level of said first control signal.

4. The liquid crystal display device according to claim 2, wherein said power recovery circuit collects electric power from a capacitance of said positive polarity data line until a voltage of said positive polarity data line becomes a first initial voltage, said power recovery circuit collects electric power from a capacitance of said negative polarity data line until a voltage of said negative polarity data line becomes a second initial voltage, said first driving amplifier circuit increases a voltage of said positive polarity data line from said first initial voltage toward said positive polarity side, and said second driving amplifier circuit decreases a voltage of said negative polarity data line from said second initial voltage toward said negative polarity side.

5. The liquid crystal display device according to claim 4, wherein said power recovery circuit further comprises a first recovery control circuit which is connected to both ends of said inductor and sets said first initial voltage and said second initial voltage, and wherein a flywheel current flows between said first recovery control circuit and said inductor in both of positive and negative directions.

6. The liquid crystal display device according to claim 5, wherein said first recovery control circuit includes a recovery control switch unit which switches a direction of said flywheel current in accordance with a polarity status of said data line group.

7. The liquid crystal display device according to claim 6, wherein said data driver further comprises an individual data line switch unit configured to cut off an electrical connection between said data line group and said inductor at a time of said collection, and wherein said flywheel current flows between said first recovery control circuit and said inductor separated from said data line group.

8. The liquid crystal display device according to claim 7, wherein said recovery control switch unit cuts off said flywheel current after said individual data line switch unit cuts off said electrical connection between said data line group and said inductor, and wherein said power recovery circuit further comprises a second recovery control circuit configured to feed a part of voltage between both ends of said inductor at a time when said flywheel current is cut off back to said power supply circuit.

9. The liquid crystal display device according to claim 8, wherein said second recovery control circuit comprises:

a first recovery circuit configured to feed said part of voltage to said positive polarity side power supply of said power supply circuit; and a second recovery circuit configured to feed said part of voltage to said negative polarity side power supply of said power supply circuit.

10. The liquid crystal display device according to claim 9, wherein said first data line is connected to one end of said inductor through a first node, said second data line is connected to the other end of said inductor through a second node, said recovery control switch unit is provided between said first node and said second node, said first recovery control circuit further includes a first recovery control diode whose anode is connected to said recovery control switch unit and a second recovery control diode whose cathode is connected to said recovery control switch unit, said timing control unit outputs to said recovery control switch unit a second control signal which controls said recovery control switch unit, and wherein, in response to said second control signal, said recovery control switch unit connects between said first data line and said first recovery control diode and between said second data line and said second recovery control diode, or between said second data line and said first recovery control diode and between said first data line and said second recovery control diode.

11. The liquid crystal display device according to claim 10, wherein said first recovery circuit includes:

a third recovery control diode of said plurality of first and second recovery diodes provided between said first node and said positive polarity side power supply; and a fifth recovery control diode of said plurality of first and second recovery diodes provided between said second node and said positive polarity side power supply, wherein said second recovery circuit includes:

a fourth recovery control diode of said plurality of first and second recovery diodes provided between said second node and said negative polarity side power supply; and a sixth recovery control diode of said plurality of first and second recovery diodes provided between said first node and said negative polarity side power supply, and wherein an electrical connection between said data driver and said data line group is cut off in response to a third control signal output from said timing control unit, said third recovery control diode discharges a part of electric power at said first node to said positive polarity side power supply, said fourth recovery control diode discharges a part of electric power at said second node to said negative polarity side power supply, said fifth recovery control diode discharges a part of electric power at said second node to said positive polarity side power supply, and said sixth recovery control diode discharges a part of electric power at said first node to said negative polarity side power supply.

12. A method of driving a liquid crystal display device which has a liquid crystal panel, said method comprising:

providing a data driver that drives a data line group of said liquid crystal panel by using a dot inversion driving method;

providing a power supply circuit that supplies electric power used in said dot inversion driving to said data driver, said power supply circuit comprising a positive polarity side power supply and a negative polarity side power supply that are different from ground;

cutting off an electrical connection between said data driver and a power recovery circuit, wherein said power recovery circuit comprises an inductor and a plurality of first and second recovery diodes;

forming an LC resonance circuit by connecting capacitance of said data line group and said inductor, and collecting electric power from said capacitance; and feeding back a part of said electric power collected by said inductor to said power supply circuit through said plurality of first recovery diodes, wherein electrodes of said inductor are respectively connected to said positive polarity side power supply and said negative polarity side power supply of said power supply circuit through said plurality of first recovery diodes, and further connected through power recovery switches and said plurality of second recovery diodes to the ground.

13. The method of driving according to claim 12, wherein said data line group includes a first data line and a second data line adjacent to each other, wherein said providing the data driver includes:

setting a voltage of one of said first data line and said second data line as a positive polarity data line to a positive polarity with respect to a voltage of a common electrode of said liquid crystal panel; and setting a voltage of the other of said first data line and said second line as a negative polarity data line to a negative polarity with respect to a voltage of said common electrode.

14. The method of driving according to claim 13, wherein said forming the LC resonance circuit includes:

collecting electric power from a capacitance of said positive polarity data line until a voltage of said positive polarity data line becomes a first initial voltage; and collecting electric power from a capacitance of said negative polarity data line until a voltage of said negative polarity data line becomes a second initial voltage, wherein said providing the data driver includes:

increasing a voltage of said positive polarity data line from said first initial voltage toward said positive polarity side; and decreasing a voltage of said negative polarity data line from said second initial voltage toward said negative polarity side.

15. The method of driving according to claim 14, wherein said forming the LC resonance circuit includes:

flowing a flywheel current through said inductor; and switching a direction of said flywheel current in accordance with a polarity status of said data line group.

16. The method of driving according to claim 15, wherein said forming the LC resonance circuit includes:

cutting off an electrical connection between said data line group and said inductor; and flowing said flywheel current through said inductor separated from said data line group.

17. The method of driving according to claim 15, wherein said feeding back includes:

cutting off said flywheel current after cutting off an electrical connection between said data line group and said inductor; and feeding a part of voltage between both ends of said inductor at a time when said flywheel current is cut off back to said power supply circuit.

18. The method of driving according to claim 15, wherein said feeding back includes:

feeding said flywheel current to said positive polarity side power supply of said power supply circuit; and feeding said flywheel current to said negative polarity side power supply of said power supply circuit.

19. The liquid crystal display device according to claim 1, wherein, with respect to said inductor, one of said electrodes of said inductor is connected to said positive polarity side power supply and said negative polarity side power supply of said power supply circuit through said plurality of first recovery diodes symmetrically with respect to another one of said electrodes of said inductor.

20. The liquid crystal display device according to claim 1, wherein said electrodes of said inductor are connected to said positive polarity side power supply and said negative polarity side power supply of said power supply circuit exclusively through said plurality of first recovery diodes.

* * * * *